US006096962A

United States Patent [19]

Crowley

[11] Patent Number: 6,096,962

[45] **Date of Patent: *Aug. 1, 2000**

[54] METHOD AND APPARATUS FOR GENERATING A MUSICAL SCORE

[76] Inventor: Ronald P. Crowley, 16 March St., Salem, Mass. 01970

[ * ] Notice: This patent is subject to a terminal disclaimer.

[21] Appl. No.: 08/387,325

[22] Filed: Feb. 13, 1995

[51] Int. Cl.[7] ..... G10H 1/40

[52] U.S. Cl. ..... 84/611; 84/DIG. 12

[58] Field of Search ..... 84/609–614, 634–638, 84/DIG. 12, 477 R, 478, DIG. 6

[56] References Cited

U.S. PATENT DOCUMENTS

| | | | |
|---|---|---|---|
| 5,281,754 | 1/1994 | Farrett et al. | 84/609 |
| 5,286,908 | 2/1994 | Jungleib | 84/609 X |
| 5,315,057 | 5/1994 | Land et al. | 84/609 X |
| 5,525,749 | 6/1996 | Aoki | 84/609 |
| 5,753,843 | 5/1998 | Fay | 84/609 |
| 5,756,915 | 5/1998 | Matsuda | 84/609 X |

*Primary Examiner*—Stanley J. Witkowski

*Attorney, Agent, or Firm*—Wolf, Greenfield & Sacks, P.C.

[57] ABSTRACT

A method practiced in connection with a computer game, video game or the like constantly evolves the game's music by permutting several basic themes and rhythms used. A harmonic pointer and rhythm pointer start the music so as to conform to a musical style desired in connection with a displayed scene or other event. Once the pointers have been set to a current musical style, the permutation process evolves the basic themes and rhythms and regenerates new music whose form is a stream of variations of the original themes thoughout the history of an individual game play experience, thus providing a large amount of musical content without having to store a large, complex, prerecorded musical score defined for each scene of the game. The amount of memory needed for musical passages is limited because a complex musical output is created from only a limited set of basic themes and rhythms. Initial musical themes are set during the game installation and musical themes evolve during the game. Playing the exact same sequence of musical notes is avoided, but the basic musical style is maintained, from one game play experience to another or even from product to another.

16 Claims, 4 Drawing Sheets

| | 1 | 2 | 3 | 4 | 5 | 6 | 7 | 8 | 9 | 10 | 11 | 12 | 13 |
|---|---|---|---|---|---|---|---|---|---|---|---|---|---|
| #1. | E1.4 | D2.h | G1.4 | A1.4 | F1.8 | R4 | R4 | B1.8 | E2.h | G1.h | D1.4 | R4 | E1.h |
| #2. | A1.4 | F1.8 | R4 | R4 | B1.8 | E2.h | G1.h | D1.4 | R4 | E1.h | E1.4 | D2.h | G1.4 |
| #3. | E2.h | G1.h | D1.4 | R4 | E1.h | E1.4 | D2.h | G1.4 | A1.4 | F1.8 | R4 | R4 | B1.8 |
| #4. | D1.4 | R4 | E1.h | E1.4 | D2.h | G1.4 | A1.4 | F1.8 | R4 | R4 | B1.8 | E2.h | G1.h |

TABLE 1

METHOD AND APPARATUS FOR GENERATING A MUSICAL SCORE

BACKGROUND OF THE INVENTION

This invention relates to the field of electronic games, and more specifically to an interactive CD ROM video game with a method for real time composing of the music score that is used by the video game. The method of permutating music allows for the control of varying the basic themes and rhythms of the video game so as to constantly provide for new musical passages within the score, also maintaining a variation of the original music though out the history of the video game.

It has been discovered that video games use music to enhance the over all atmosphere of the game in play. By adding dramatic and emotional music in the right section of the video game, the player has a much more exciting gaming experience. In music scores written for motion pictures, if the music is a predefined composition and played repeatedly can destroy the plot and annoy the movie audience. A background musical score which has continuity with the original theme but is evolving continuously, will be background music and will not interfere with the movie.

In previous video games the music score had to be completely prerecorded, as MIDI data or digital sound samples, in order to provide sound though out the game play. This could be as much or more than an hour of music taking up valuable memory space, as well as the time needed to access the information from the CD ROM media, causing conflicts between the image data and the music data that must be retrieved. If memory is limited, then the music is fixed by prerecorded sequences and the same sequences would be heard over and over again.

It is desirable to provide an improved musical composition system and method for limiting the amount of prerecorded music, by creating new music during the play of the game using the basic themes and rhythms provided at the installation of the video game media. By using the method of the present embodiment the amount of memory needed by the video game to store prerecorded musical passages is decreased, because only the starting themes and rhythms need to be stored, thus providing a large amount of music without the expense of the added memory storage.

BRIEF SUMMARY OF THE INVENTION

Accordingly, it is the object of the present invention to provide a system and method for constructing a controlled permutated musical score. The method is used to limit the amount of memory needed for musical scores by providing for the development of infinitely evolving music through out the use of the video game. The musical theme's are set at the beginning of the game installation and they will evolve during the history of the video game, which avoids playing the exact same sequence of musical notes from game play to play. Actually, every individual user's game could be playing different variations on the theme of the game depending on their actions. This technique regenerates new music in real time or the music may be stored for later play, maintaining the original themes and rhythms and does not just simply pick or play the new music from previously recorded stored compositions.

Since the starting theme memory requirements do not change, the memory savings improvement, is an function of the recursive level set and the process can achieve greater than 93% improvement in memory storage needs even when the recusive level is at the lowest value of 2.

Therefore, it has been found that the repetition of the music can become boring in the repeated use of the game media. By providing for permutated music as disclosed in the present invention, the users musical interest will be maintained by the constant evolution of the music. This process causes each individual game media to be playing virtually different music, but will maintain the same basic theme desired by the content of the media in use.

BRIEF DESCRIPTION OF THE DRAWINGS

For a further understanding of the nature and the object of the present invention, reference is made to the following drawings in which like parts are given like reference numerals, and wherein.

DETAILED DESCRIPTION OF THE PREFERRED EMBODIMENT

The system and method of this invention is used to select and permutate from storage memory, a starting theme sequence of, a finite predetermined or random number of frequency and duration values into a constantly evolving musical score. In the system and method of the present embodiment, we are referring to creating musical scores for CD ROM computer video games, but the system and method can easily be used to create evolving background scores for Information CD ROMs, such as Encyclopedias, cartridge video games, arcade video games, including pinball machines, toys, musical keyboards. A starting theme sequence is used to control the correct background theme music for the current scene. In the method of the present invention, the harmonic and rhythm information are treated separately to allow for greater flexibility of variation in the regeneration of the initial theme. For instance, the harmonic content of the score could change frequency while the rhythm content of the music stayed the same or vise versa. The system and method also provides for the storage of multiple starting themes, which could introduce a different character theme or dramatic theme sequence representing the content of a scene. The output of the system, the output score, can be generated in real-time and passed directly to the output audio system, which includes digital to analog converters, amplifiers and speakers or the output score can be stored in memory to be played back at a different time than it was created by the same audio system.

The intent of the system and method of the present invention is to generate an unlimited amount of evolving music with a predefined thematic content, without having to previously have stored the entire musical score, thereby, limiting the amount of memory needed by the system and method.

Figures 2A, 2B:
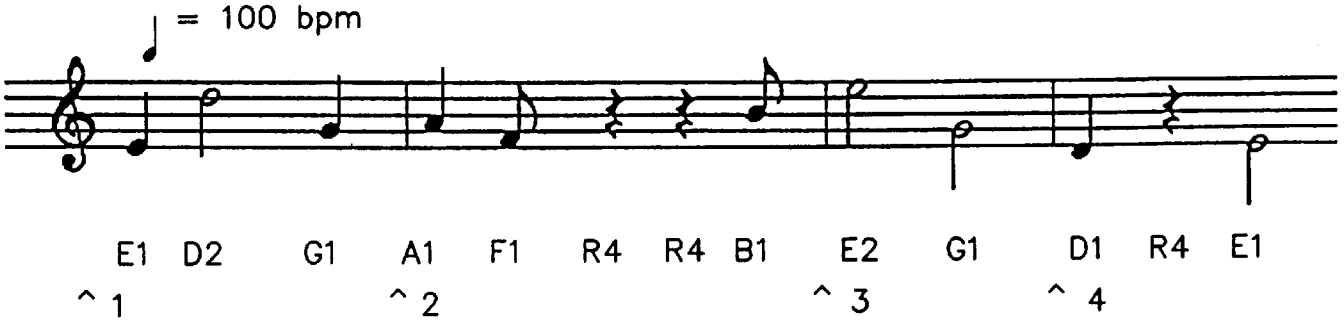
FIG. 2A is an example starting theme represented by the music notation and a table diagram representing the music groups used in the practice of the system and method of the present embodiment.
FIG. 2B is a table illustrating a four-part permutation of the theme of FIG. 2A.

In the example illustrated in FIG. 2B, the starting theme sequence contains sixteen music events representing the theme to evolve in four bars, In this example, FIG. 2B shows four part permutation #1, #2, #3 and #4. The first part #1 plays the sequence from the beginning ^1, ^2, ^3, ^4 starting with group ^1 as shown illustrated in the music notation. The second part plays the sequence starting with group ^2 continuing with ^3, ^4 and returning back to group ^1. The third part starts ^3, ^4, ^1, ^2 and the fourth ^4, 1^1, ^2, ^3. In this example, it is chosen to group by four music events with a sequential forward permutation, but any number of groups can be created from one music event creating 16 groups up to the limit of the complete root theme, creating one whole group and producing unlimited sequence combinations to start with.

Many other sequences, random or sequential may also be used. For example, it is possible for the groups not to be uniform, for instance, sixteen music events could be grouped ^4, ^8, ^4, which would create 3 groups. It is also possible to separate the harmonic content and the rhythm content and group them differently. As in this example the harmony could be grouped by ^4, ^8, ^4 music events creating 3 groups and the rhythm could be grouped by ^2, ^2, ^4, ^4, ^4 music events creating 5 groups to work with.

It is well know that a repeated theme playing over and over again can become boring, which could cause the player to shut the music off given the option, eliminating the desired intent of the initial design goal of the product. To have the music evolve unobtrusively from game play to game play would provide for a longer play time of enjoyment of the music for the player, while maintaining the intended design experience of the system.

Figures 1A, 1B:
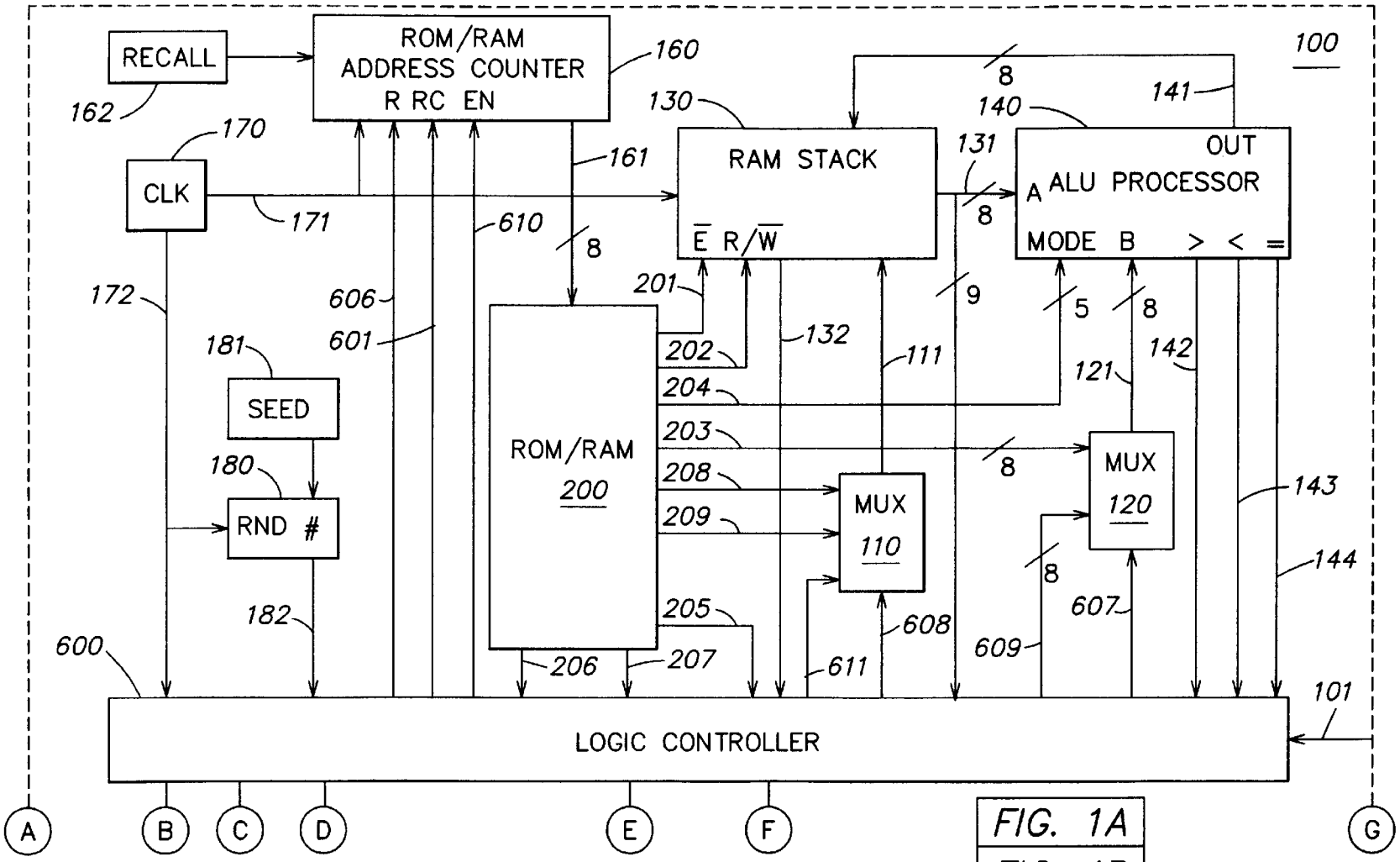
FIG. 1 is a block diagram of the system used by the Music Composer including the Theme, Rhythm and Score RAM Storage and the Processor of the present embodiment.
Figure 1B:
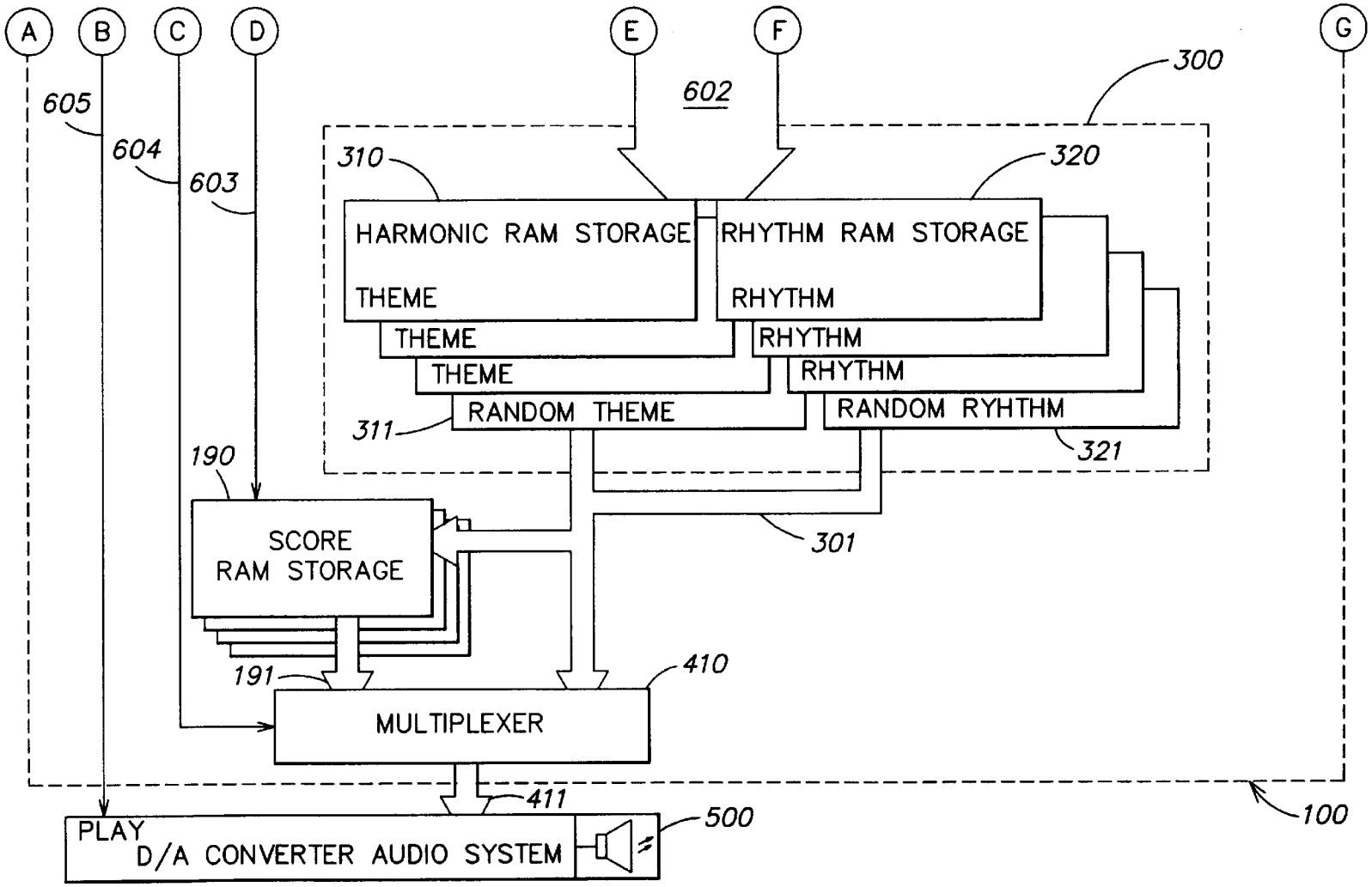

As shown, FIG. 1 is a block diagram of the system and method including the Theme and Score RAM Storage and the Processor used by the game. The game media means of the preferred embodiment may use either compressed floppy disk based games, stand alone video systems, or CD ROM based games. CD ROM media is the preferred video game media of the present embodiment.

Referring to FIG. 1, The system 100 of the present embodiment provides for the processor logic, the Logic Controller 600, the Theme RAM Storage 300, which includes the Harmonic RAM Storage 310 and the Rhythm RAM Storage 320. Also included is the RAM storage 311, 321 which provides for the storage of new random themes and rhythms, respectfully. RAM Storage 190 is provided for the saving of the output score, if storage is desired.

In the system and method of the present invention, the processor logic includes the timing reference CLK 170, this controls the timing of the system by supplying the signal 171 to ROM/RAM address counter 160 and timing signal 172 which supplies the clock to the Logic Controller 600, which will be described later. The ROM/RAM address counter 160 provides the binary data 161 needed to step the system program ROM/RAM 200 which will recursively generate the desired amount of music needed by a specific event. This program ROM/RAM 200 stores the micro-code needed to produce the system and method of the present invention. By setting the starting recursive level of the process and the theme pointers, a musical score with a predetermined length of time can be generated.

The CLK 170 also provides the clock signal 171 needed by the Random Access Memory stack 130, which is used to hold the recursive data for each level, representing a theme pointer, a rhythm pointer and the recursive level number, respectfully. The RAM stack 130 is enabled by signal 201 and the read/write mode of the stack 130 is controlled by signal 202 which are generated by the program ROM/RAM 200 in the normal operation of the present embodiment. When the stack 130 is empty, a flag signal 132 denotes this condition. A recursive level number and theme pointer are stored in the stack 130 at the appropriate time in the process, which will be described in more detail as referenced in the timing diagram of FIG. 3.

The stack 130 output 131 passes data to the A input of the Arithmetic Logic Unit Processor 140. This ALU processor 140 can be configured for comparing, adding and subtracting, but is not limited to the above arithmetic functions. The arithmetic mode of the ALU processor 140 is set by binary signals 204. These signals 204 are stored in program ROM/RAM 200 and are used to set the appropriate arithmetic function needed by the method of the present embodiment. The program ROM/RAM 200 also stores the binary data which is used by the B operand of the ALU processor 140. When in write enable mode, the output 141 of the ALU processor 140 is feed into the input of the RAM stack 130 where the data can be stored as determined by signal 201 for use by the next recursive process of the system 100. When the ALU processor 140 is in a specific compare mode as set by signals 204 such as, when A input 131 is compared to B input 121, the B input 121 is derived from multiplexer 120, this multiplexer is switched by signal 607 to select between input 203, which is a data bus representing an operand for the ALU processor and the starting level data bus 609, which is the first recursive level value. Multiplexer 110 is switched by signal 608 to select between input data bus 208 which is a theme pointer, the input data bus 209 which is another theme pointer or starting input data bus 611. The output data 111 of the theme pointer multiplexer 110 which is a data bus representing the theme pointer that selects the group derived from one of the starting themes, is passed to the stack 130 and combined with the recursive level data bus 141. The theme multiplexer 110 can have more than two inputs, not including the starting data input 611, two are used only for ease of illustration. Referring back to the ALU 140, if A is less than B, the result flag<143 signals when this state is true. If A is equal or greater than B the result, flags = 144 and > 142 signal when these states are satisfied, respectfully. Signal flag < 143 is switched by signal 205 from the program ROM/RAM 200 and is used by the Logic Controller 600 which determines when the system 100 is to either store the music in Score RAM Storage 190 for play at a later time or play the generated music in progress. If the score, represented by binary data bus 301, is to be played at a later time than it was created, the Logic Controller 600 must first store the data 301 in memory, the Score RAM Storage 190. The signals 603 control the Score RAM 190 operation by proving the clocks and correct addresses necessary to read data in and write data out of the memory 190. The Logic Controller 600 will select the Multiplexer 410 input 191 from Score RAM Storage 190 with signal 604 and switch this input 191 to the output 411 which in turn is feed to the input of the D/A converter Audio System 500, then play flag 605 signals the Audio System 500 to play the created score.

In the score 301, is to be played while it is evolving, no memory storage is needed and the Logic Controller 600 will select the Multiplexer 410 input 301 from Theme RAM Storage 300 with signal 604 and switch this input 301 to the output 411 which in turn is feed to the input of the D/A converter Audio System 500, then play flag 605 signals the Audio System 500 to play the created score while it is being generated by the system and method of the present invention.

The Logic Controller 600 provides a reset flag 606 used to signal the program ROM/RAM Address Counter 160 when to reset the music system. An enable flag 610 is used to signal the program ROM/RAM Address Counter 160 that is can proceed with the music evolution process. Signal flag 601 is used to load the recall address 162 into the program ROM/RAM Address Counter 160, this is the beginning of the recursive process, which is repeated from this point in the micro-code. Signals 207 for program ROM/RAM 200 selects which theme pointer is to be used in the process, the one from the random generator or the one from the stack 130, as part of the recursive data bus 131. If the theme pointer is selected by a random selection, then the group played will be governed by the list generated by the starting seed 181. If the theme pointer is selected by the stack the group played will be controlled by the recursive process. There is also a multi-bit computer bus input 101 which is provided to transfer data between another computer and the program memory 200 via the Logic Controller 600. The program memory 200 in this case would be read access memory RAM or electrical erasable programmable read only memory EEPROM, replacing the simple read only memory ROM. This computer bus can also supply the signal needed to start the process.

In one mode of operation, the theme pointers 131 from the RAM stack 130 are passed to the Logic Controller 600 and are used to select which notes or groups to play from a predefined or random sequence of permutations, which are determined at the start of the recursive process. These themes, which are stored in Theme RAM Storage 300 are selected using signals 602 for the Harmonic and Rhythm RAM Storage 120.

In an alternate mode of operation, signal 207 will select the code signal 182 from Rnd # generator 180. This code sequence is generated from a starting seed 181 and is clocked by signal 172. The Rnd # generator 180 creates pseudo random numbers which can be used to select notes or segments to play creating a random list of permutations. By changing the seed 181 used by the Rnd # generator 180, an unlimited number of lists of random numbers can be generated, providing a great variety of musical evolution. By keeping the seed 181 the same, the exact score can be regenerated over and over again, if desired. By storing only a small percentage of the theme of the entire score, very little memory is needed as compared to storing the whole predefined score which could consume a large amount of memory or limit the musical content using repetition.

The Rnd # generator 180 can also be used to produce a random starting theme 300 used in the practice of the present embodiment. The random harmonic and random rhythm data is stored in Harmonic RAM Storage 311 and Rhythm RAM Storage 321. The new themes are generated by selecting random frequency values and duration data. The amount of notes in a theme can be selected as well as if single notes or groups of notes are evolved into scores.

The Rnd # generator 180 can also used to produce a random starting grouping, used to divide the initial theme into parts to use for evolution of the output score. The ability to create pseudo random numbers is well know in the art and will not be detailed in the present embodiment. The starting theme sequence 300, which can be a prerecorded sequence 310, 320 or a randomly generated sequence 311, 321 is selected by the Logic Controller 600 from signals 602. These signals select which group of the starting theme to play.

An important aspect of the present invention includes using an initial starting theme to maintain a variation of the thematic content desired and playing the generated score in real time, while in its evolution, eliminating the need for storing a large amount of musical content for the system using this method.

FIG. 2 is an example starting theme represented by the music notation and a table diagram representing the music groups and permutation used by the method in the construction of the method of the present embodiment.

Referring to FIG. 2, there is shown a sequence of music events representing a theme shown in standard music notation and a table showing 4 music parts derived from the forward sequential permutation of the theme. In the table, E1.4 is a frequency of a note E in octave 1 and the duration equals a quarter note denoted as 0.4. 0.8 equals an eighth note, .h equals a half note and R4 equals a quarter rest. The timing of these durations are determined by the BPM Beeps per minute set in the playback of the output score, in this example the BPM is equal to 100. The starting sequence $_1$E1.4, D2.h, G1.4 $_2$A1.4, F1.8, R4, R4, B1.8 $_3$E2.h, G1.h $_4$D1.4, R4, E1.h as shown in standard music notation is listed in Table 1. as part #1. As can be seen in the table, part #2 is created by forward sequential permutation of part #1 yielding a part represented by the sequence $_2$A1.4, F1.8, R4, R4, B1.8 $_3$E2.h, G1.h $_4$D1.4, R4, E1.h $_1$E1.4, D2.h, G1.4. Part #3 is created by forward sequential permutation of part #2 yielding a part represented by the sequence, $_3$E2.h, G1.h $_4$D1.4, R4, E1.h $_1$E1.4, D2.h, G1.4 $_2$A1.4, F1.8, R4, R4, B1.8 and Part #4 is created by forward sequential permutation of part #3 yielding a part represented by the sequence $_4$D1.4, R4, E1.h $_1$E1.4, D2.h, G1.4 $_2$A1.4, F1.8, R4, R4, B1.8 $_3$E2.h, G1.h. This is only a single example of the vast possibilities of generating parts for use in the practice of the present invention, as reference to earlier. In this example only a single line of music is represented in the table, possibly an oboe playing a single line of music, but a number of parts can be used to create a complete complex orchestra or musical unit of any size or instrument combinations. Also, only a simple forward sequential permutation is shown.

Referring to FIG. 2, using a numerical example, assume; BPM beats per minute=100, one event=a quarter note, each quarter note has a duration = to 0.6 seconds, there are 4 event time slots in one bar, one bar has a duration of 2.4 seconds, there are 4 bars in the starting theme and the total duration of 4 bars is 9.6 seconds. Next, calculate the total amount of bars, the score, thats generated by taking the amount of groups the starting theme is split into and raising that value to the power of the maximum recursion level. For ease of understanding, assume a simple 4 part forward sequential permutation, there are 4 groups and also assume a maximum recursion starting level of 6.

$$\text{total bars generated} = \text{groups}^{level} = 4{,}096 = 4^6$$

The score has a total of 4,096 bars of evolving music based on the starting theme. The total time of this score equals 4,096 bars multiplied by 2.4 seconds per bar equals approximately 2 hours and 44 seconds. Now, as further example assume a storage comparison between a full sampled score and the score generated by the evolution process as detailed in the present embodiment. First, assume a sample rate of 44,100 SPS samples per second, 44,100 SPS multiplied by 2.4 seconds per bar=105,840 samples multiplied by 16 bit stereo, 4 bytes=423,360 bytes multiplied by 4096 bars=1,734,083,000 or approximately 1.7 gigabytes of memory for the full sampled score compared to having only to store the starting theme of 2.4 seconds or 423,360 bytes of memory storage using the method of the present invention. That becomes greater than a 99% improvement of storage memory using the present method than having to store almost 3 hours of music. Storing 3 hours of music using prior art becomes impractical, because optionally video may also want to be stored on the same media and this could exceed the current limitations in the storage capacity of the present memory media, therefore the music becomes very repetitious or not at all, as stated earlier. Since the starting theme memory requirements do not change, the memory savings improvement, is an function of the recursive level set and can achieve greater than 93% improvement in memory storage needs even when the recusive level is at the lowest value of 2 generating the least amount of music.

Figure 3:
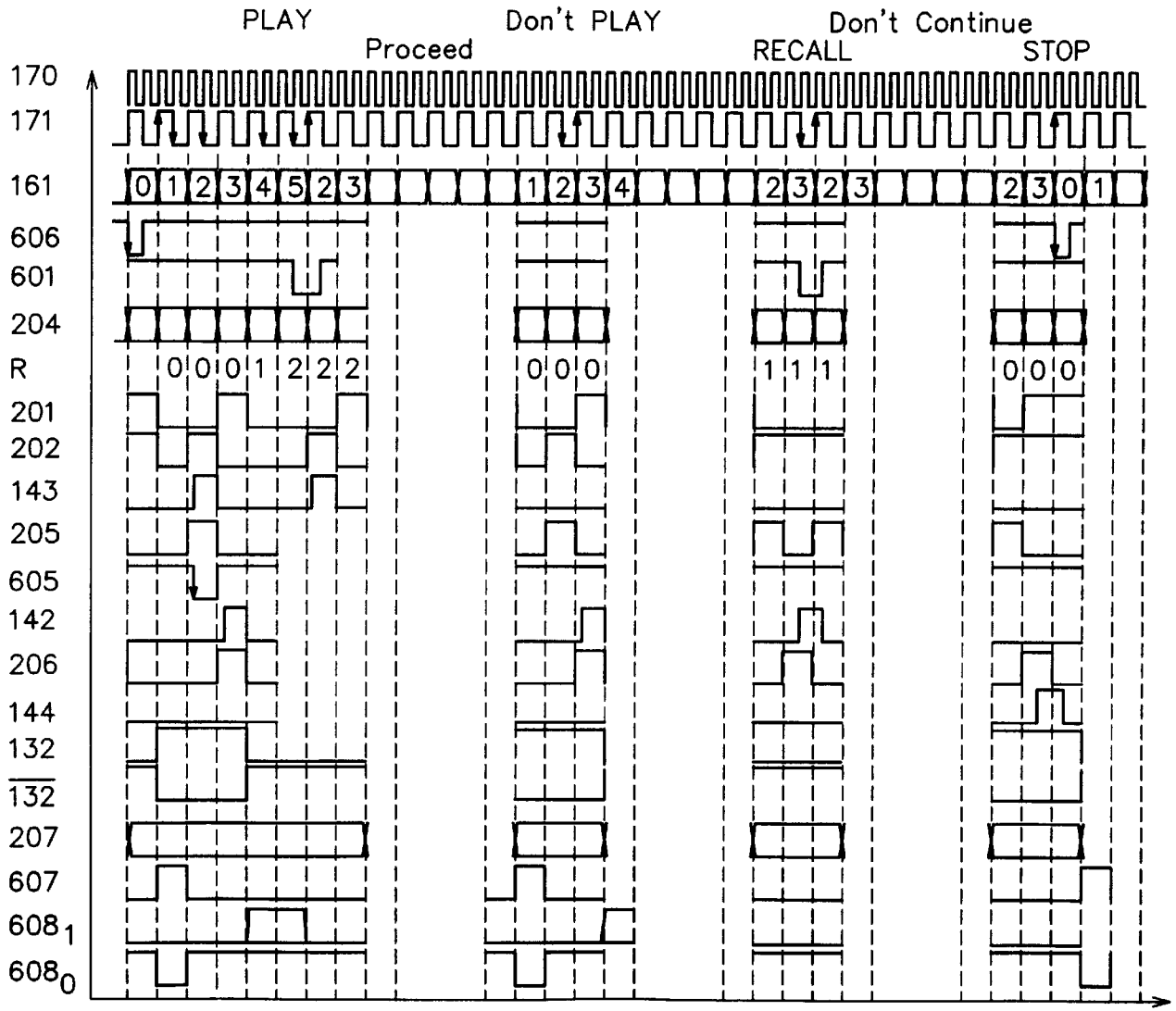
FIG. 3 is a timing diagram of the system and method used in the practice of the present embodiment.

FIG. 3 is a timing diagram of the system and method used in the practice of the present embodiment.

Referring to FIG. 3, there is shown the master clock signal 170, this represents the base timing reference used by the present embodiment. A system clock 171 which is derived from master clock 170, is used to set the timing and to generate event interrupts for the control devices used the system. The next signal illustrated is derived from ROM/RAM Address Counter producing the signal 161, this digital data is used to set the state of the processing by providing the address for the program ROM/RAM, including the RAM stack, this comprises a state machine. The signal 161 represents at least a byte of address applied to the ROM/RAM, providing 256 states. Signal 606 is used to set the machine to the reset state, state 0, which signifies that the method is at the beginning of the process. Signal 601 is used to set the machine to the start of the recursive state, to repeat the process. Selecting the mode of the ALU processor is controlled by mode select signal 204. The RAM stack enable signal is shown by 201 and the read or write signal is represented by 202. The ALU processor compare flags are shown as greater than > flag 142, less than < flag 143 and equals = flag 144. Signal 205 is used to enable the play function, the continue function or the recall function is enabled by 206. The timing signal 132 and 132 bar are used to signal when the stack is empty and at state 0. Signal 207 is used to select between a random theme group list or the theme group passed in the recursive process in the practice of the present embodiment. The select signal 607 chooses between the starting data bus or the program memory data bus and the select signals $\mathbf{608}_0$, $\mathbf{608}_1$ are used to select between the starting theme data bus and the theme pointers that are used in the process.

As stated above, the program ROM/RAM 200 as referenced in FIG. 1 is used to store the micro-code program needed to operate the system and method of the present embodiment. The system produces the timing data as referenced in FIG. 3, a detailed description of the process follows.

To start the process, the first thing to do is to reset the system with signal 606, this sets the program counter 160 to zero and the micro-code of program ROM/RAM 200 to the resting state 0. The starting recursive level, the starting harmonic pointer and the starting rhythm pointer have to all be given values and this is accomplished in the next step of the micro-code state 1. The starting recursive level in the example, referenced by FIG. 3, can be one of 256 values. The starting harmonic and rhythm pointers in the example, referenced by FIG. 3, can have a value of 1 or 0, selecting between two groups. This step starts by first setting the ALU Processor Mode 204 to a multiplexing mode and then selecting the B operand which is the output from multiplexer 120. Then the control signal 607 selects data input 609 from the Logic Controller 600, which holds the starting recursive level. The starting harmonic and rhythm pointers are selected by signal 608 from input 611 also from the Logic Controller 600. These values may be altered by computer bus input 101, by physical switches one must set or firmware stored in memory such as ROM. The multiplexing mode allows the B input 121 to pass through to the output 141 unaffected by operand A 131. When the clock signal 171 switches to a high state, begining state 1, the ALU passes the data to the output, sets the stack 130 memory enable 201 low, and switches signal 202 low, this allows writing of the output 141 from the ALU 140 into the stack 130, after the clock 171 switches to a low state, the first recursive value, including the theme pointers are pushed onto the stack. The stack is now pointing to the first register which has a value, register 0, this is referenced by label R, column labeled PLAY Proceed, as part of the timing diagram in FIG. 3.

When the clock signal 171 switches to a high level again, this begins state 2 which is the recall state, in this step a comparison is made between the current recursive value on the stack 130 and the current micro-code data, the play value 203. The processor mode for the ALU 140 is set by signals 204 to compare A:B, the stack 130 memory enable 201 is set low and signal 202 switches high, allowing to read the current recursive value from the stack. The value is pulled from the stack and this becomes the data at the bus 131 when the clock 171 switches to a low state. The stack still points to register 0, this is referenced by label R, column labeled PLAY Proceed, as part of the timing diagram in FIG. 3.

If the stack data thats applied to the A input 131 is less than the current micro-code value, the play value, which is the data thats applied to the B input 121 of the ALU, than play the sequence 301. The B input 121 is derived from multiplexer 120 which will select, by signal 607, the data bus 203, the value that determines when to play a theme sequence, in this example it is set to a value of 1. Any recursive value below 1 will play the sequence thats on the stack 130 using the current harmonic pointer and the current rhythm pointer, as part of the data 131. The play enable signal 143 is switched with signal 205 from the micro-code, this is used to turn on the play signal 605 only in the play mode. This negative going pulse 605 is used to interrupt the Logic Controller 600 to produce the correct addresses 602 needed to access the Theme RAM Storage 300 and to tell the Audio System 500 that the Theme RAM is sending music data to play. The stack points to register 0 in this state as is referenced by label R, column labeled PLAY Proceed, as part of the timing diagram in FIG. 3.

If the stack data thats applied to the A input 131 is not less than the current micro-code value, the play value 203, which is the data thats applied to the B input 121 of the ALU 140, than simply continue to the next state without playing a group theme sequence. The process continues on to the next state, state 3, whether the comparison is true or false. The stack still points to register 0 in this state as is referenced by label R, column labeled Don't PLAY Proceed, as part of the timing diagram in FIG. 3.

The clock signal 171 switches to a high state again and begins state 3, this step performs a comparison between the current recursive value on the stack 130 and the continue value to determine if the process should proceed, be recalled or stopped. The processor mode of the ALU 140 is set by signals 204 to compare A:B, if the stack data thats applied to the A input 131 is greater than the current micro-code data the continue value 203, which is the data thats applied to the B input 121 of the ALU, then continue the process to the next step. The B input 121 is derived from multiplexer 120 which will select, via signal 607, the data bus 203, the value that determines when to continue the process, in this example the value is set to 0. Any recursive value above 0 with continue the process to the next state, state 4. The stack is pointing to register 0, that is referenced by label R, column labeled PLAY Proceed or column labeled Don't PLAY Proceed, as part of the timing diagram in FIG. 3.

If the comparison is not equal to 0, the stack 130 memory enable 201 is set low and signal 202 switches high, allowing to read the previous recursive value from the stack, this becomes the value 131 when the clock 171 switches to a low state, this value is pulled from the stack, causing the stack pointer to decrease by one. The process returns to the recall state, state 2, by loading the recall address 162 into the address counter 160 when signal 601 is low and the clock 171 switches high. The recall address is hard wired as part of the state machine, but this value also can be altered. The RECALL flag 601 is produced by gating the greater than > flag 142 with the inverse of the empty flag 132 and the micro-code data 206. The procedure will be repeated returning to state 2 until the process reaches the first register of the stack 130 signaled by the empty flag 132 and the value stored in the first register is 0, which will conclude the process for this theme. At this state, the stack will be recursively pointing to the current register - 1, until the stack is empty and points to register 0. The stack is pointing to register 1, as referenced by label R, column labeled Don't Continue RECALL, as part of the timing diagram in FIG. 3.

If the comparison is equal to 0 the continue limit value, and the stack flag 132 is low, signaling the stack 130 is empty, then the method has completed and the reset flag 606 is sent to reset the system to the wait state, state 0. The equal output signals this condition and is referenced by flag = 144 which is gated with signal 206 from the micro-code ROM/RAM 200 and the stack flag 132, this produces the reset flag 606 and is used to determine if the process should stop. The stack is pointing to an empty register 0, this is referenced by label R, column labeled Don't Continue STOP, as part of the timing diagram in FIG. 3.

If the process can continue, when the clock signal 171 switches to a high state, state 4 begins, this step performs a subtraction between the current recursive value which is on the stack bus 131 and the subtrator value, the B input 121 of the ALU. The B input 121 is derived from multiplexer 120 which will select, via signal 607, the data bus 203, which in this case the value is 1. Before the current recursive value is stored in the stack, the theme pointers have to be selected. This is accomplished by decoding the current theme pointer from data bus 131. In the present example, the theme pointer has two values, 1 and 0. If the current pointer from data bus 131 is equal to 0 then select the 1 pointer or if the current pointer from data bus 131 is equal to 1 select the 0 pointer. The different pointers are selected by decode signal 608, which selects between the theme data bus 208, the theme data bus 209 or the starting theme data bus 611, which results in data bus 111. This bus 111 is combined with data bus 141 to complete the data input of the stack 130. The processor mode for the ALU 140 is set by signals 204 to subtract B:A. This subtracts 1 from the current recursive value 131, when the clock signal 171 switches to the high state the ALU performs the subtraction and then sets the stack 130 memory enable 201. When signal 202 is low, this allows writing the output 141 from the ALU 140 connected to the stack 130, when the clock 171 switches to a low state, resulting in advancing the stack pointer by one and pushing the data on the stack. The stack is now pointing to register 1, this is referenced by label R, column labeled PLAY Proceed or Don't PLAY Proceed, as part of the timing diagram in FIG.3.

The clock signal 171 switches to a high state again, state 5 starts, this step stores the subtraction result 141 the current recursive value, in the next stack register. The next two theme pointers have to be selected. As mentioned earlier, this is accomplished by decoding the current theme pointer from data bus 131, as stated, if the current pointer decoded from data bus 131 is equal to 0 then select the 1 pointer or if the current pointer decoded from data bus 131 is equal to 1 select the 0 pointer. The different pointers are selected by decode signal 608, which selects between the theme data bus 208, the theme data bus 209 or the starting theme data bus 611, this resolves into data bus 111. As mentioned above, this data bus 111 is combined with data bus 141 to complete the input data bus of the stack 130. The stack memory enable 201 stays low and signal 202 stays low, this allows writing the output from the ALU 140 into the next stack register when the clock 171 switches to a low state. This results in advancing the stack pointer by one and pushing the data on the stack. The stack is now one position forward and holds the next recursive value 131 which is the same as the previous value. The next step is to repeat the process by returning to the recall state, state 2, by loading the recall address 162 into the address counter 160 when the signal 601 is low and the clock 171 switches high. The procedure will be repeated returning to state 2 until the process reaches the STOP state, which would conclude the process for this evolution.

Although the method described in detail above is most satisfactory and preferred, many of these variations in structure and method are possible. Many of these variations have been set out above and are examples of possible changes or variations. Also, for example, the source for any video media could consist of CD ROMs, cartridge ROMs, Floppy disks, or any other media, which could be magnetic tape, magnetic disk, optical disk, magneto optical disk. Also, for example, the music could be sampled data or MIDI data. They are not to be considered exhaustive.

Because many and different embodiments may be made within the scope of the inventive concept herein taught and because modifications may be made in accordance with the descriptive requirements of the law, it should be understood that the details herein are to be interpreted as illustrative and not in a limiting sense; however, it is recognized that various certain modifications, additions and improvements may be made in the illustrated embodiments by those persons skilled in the art, all falling within the spirit and scope of the invention.

What is claimed as invention is:

1. An apparatus for selecting a partial sequence from a previously stored primary music sequence, a desired partial sequence to be composed of a specified percent of the primary music sequence, wherein the primary music sequence if composed of a harmonic part and a rhythmic part, wherein the primary music sequence is grouped into partial sequences, and wherein each group of partial sequences are recursively switched a predetermined number of times, which apparatus comprises:

a) means for arranging the selected parts of each partial sequence in a predetermined ordering to be played, the sequence of the ordering being predetermined and not necessarily the same for the harmonic and rhythm parts, and the starting point for the partial sequences for each successive sequence being dependent upon the preceding partial sequence selected;

b) storage means for storing harmonic music data representing a plurality of randomly selectable primary harmonic sequences to establish the starting harmonic musical style of a current event in the operation of the apparatus;

c) another storage means for storing rhythmic music data representing a plurality of randomly selectable primary rhythm sequences to establish the starting rhythmic musical style of a current event in the operation of the apparatus;

d) another storage means for storing recursive data representing a stack containing level values and theme pointers to use in the evolution of the score in the operation of the apparatus;

e) another storage means for storing state machine data used to produce the evolution of the score in the operation of the apparatus;

f) counting means coupled to said state machine storage means for generating a sequence of events in the operation of the apparatus;

g) logic control means coupled to said counting means and to said state machine storage means and to said stack storage means and to said rhythmic storage means and to said harmonic storage means to control the status and function of state events in the operation of the apparatus;

h) control means coupled to said logic control means selecting a next one of said sequences of harmonic and rhythm music data representing a partial musical score to play by said apparatus in response to a current event in the operation of the apparatus;

i) processor means coupled to said control means and to said logic control means and to said state machine storage means and to said stack storage means which functions collectively as a state machine responsive to a current event in the operation of said apparatus;

j) generator means coupled to said logic control means for generating a sequence of random numbers dependent on a starting seed number value used for the selection of harmonic and rhythmic music data in the operation of said apparatus;

k) counting means coupled to said generator means for generating a predetermined total amount of numbers for the said random number sequence;

l) another storage means coupled to said logic control means and to said harmonic storage means and to said rhythmic storage means representing a complete musical score for later play in the operation of said apparatus; and m) multiplexer means coupled to said score storage means and to said harmonic storage means and to said rhythmic storage means used to select between playing the score from score storage or playing the score in real time in the operation of said apparatus.

2. The apparatus of claim 1 further comprising plural primary harmonic sequences stored in the storage means for storing harmonic music data establishes the harmonic musical style of more than one event in the operation of the apparatus.

3. The apparatus of claim 1 wherein the primary harmonic sequence stored in the storage means for storing harmonic music data includes a random harmonic sequence to establish the harmonic musical style of the current event in the operation of the apparatus.

4. The apparatus of claim 3 wherein the random harmonic sequence stored in the storage means for storing harmonic music data further comprises multiple random harmonic sequences to establish the harmonic musical style of more than one event in the operation of the apparatus.

5. The apparatus of claim 1 wherein the plurality of primary rhythm sequences stored in the means for storing rhythmic music data establish the rhythmic musical style of more than one event in the operation of the apparatus.

6. The apparatus of claim 1 wherein the plurality of primary rhythm sequences stored in the means for storing rhythmic music data includes a random rhythm sequence to establish the rhythmic musical style of the current event in the operation of the apparatus.

7. The apparatus of claim 6 wherein the random rhythm sequence stored in the means for storing rhythmic music data includes multiple random rhythm sequences to establish the rhythmic musical style of more than one event in the operation of the apparatus.

8. The apparatus of claim 1 further comprising multiple state machines to establish the music scores of more than one event in the operation of the apparatus.

9. A method for selecting a partial sequence from a previously stored primary music sequence, desired partial sequence to be composed of a specified percent of the primary music sequence, wherein the primary music sequence is composed of a harmonic part and a rhythmic part, wherein the primary music sequence is grouped into partial sequences, and wherein each group of partial sequences are recursively switched a predetermined number of times, which method comprises:

a) arranging the selected parts of each partial sequence in a predetermined ordering to be played, the sequence of the ordering being predetermined and not necessarily the same for the harmonic and rhythm parts, but the starting point for the partial sequences for each successive sequence being dependent upon the preceding sequence selected;

b) storing harmonic music data representing a plurality of randomly selectable primary harmonic sequences to establish the starting harmonic musical style of a current event in the operation of the system;

c) storing rhythmic music data representing a plurality of randomly selectable primary rhythm sequences to establish the starting rhythmic musical style of a current event in the operation of the system;

d) storing recursive data representing a stack containing level values and theme pointers to use in the evolution of the score in the operation of the system;

e) storing state machine data used to produce the evolution of the score in the operation of the system;

f) generating, based on the state machine data stored, a sequence of events in the operation of the system;

g) controlling the status and function of state events in the operation of the system, responsive to the steps of storing harmonic music data, storing rhythmic music data, storing recursive data and storing state machine data;

h) selecting a next one of said sequences of harmonic and rhythm music data representing a partial musical score to play by said system in response to a current event in the operation of the system;

i) operating a state machine responsive to a current event in the operation of said system;

j) generating a sequence of random numbers dependent on a starting seed number value used for the selection of harmonic and rhythmic music data in the operation of said system;

k) generating a predetermined total amount of numbers for the said random number sequence; i) representing in a storage device a complete musical score for later play in the operation of said system; and m) selecting between playing a score from the storage device or playing the score in real time.

10. The method of claim 9 which includes multiple harmonic sequences to establish the harmonic musical style of more than one event.

11. The method of claim 9 which includes random harmonic sequence to establish the harmonic musical style of the current event.

12. The method of claim 11 which includes multiple random harmonic sequences to establish the harmonic musical style of more than one event.

13. The method of claim 9 which includes multiple rhythm sequences to establish the rhythmic musical style of more than one event.

14. The method of claim 9 which includes random rhythm sequence to establish the rhythmic musical style of the current event.

15. The method of claim 14 which includes multiple random rhythm sequences to establish the rhythmic musical style of more than one event.

16. The method of claim 9 which includes multiple state machines to establish the music scores of more than one event.

* * * * *